US005297592A

United States Patent [19]

Takegawa

[11] Patent Number: 5,297,592

[45] Date of Patent: Mar. 29, 1994

[54] METHOD OF DISCHARGING A WEFT YARN WOUND AROUND A DRUM

[75] Inventor: Yujiro Takegawa, Kahoku, Japan

[73] Assignee: Tsudakoma Kogyo Kabushiki Kaisha, Iskikawa, Japan

[21] Appl. No.: 18,321

[22] Filed: Feb. 16, 1993

[30] Foreign Application Priority Data

Feb. 18, 1992 [JP] Japan ..... 4-060995

[51] Int. Cl.[5] ..... D03D 47/34

[52] U.S. Cl. ..... 139/450; 139/116.2; 139/452

[58] Field of Search ..... 139/116.2, 452, 450

[56] References Cited

U.S. PATENT DOCUMENTS

| | | | |
|---|---|---|---|
| 5,080,144 | 1/1992 | Takehana | 139/116.2 |
| 5,123,455 | 6/1992 | Maina | 139/452 |
| 5,158,120 | 10/1992 | Kaufmann et al. | 139/116.2 |
| 5,209,271 | 5/1993 | Takegawa | 139/116.2 |

FOREIGN PATENT DOCUMENTS

| | | |
|---|---|---|
| 2-210043 | 8/1990 | Japan . |
| 3-104965 | 5/1991 | Japan . |
| 3-180544 | 8/1991 | Japan . |

*Primary Examiner*—Andrew M. Falik

*Attorney, Agent, or Firm*—Wenderoth, Lind & Ponack

[57] ABSTRACT

When a weft yarn is broken between a fixed drum type weft yarn measuring and storing device and a picking nozzle, the weft yarn extending to a winding yarn guide is reliably delivered to a yarn suction device by the steps of generating an air current inside the winding yarn guide in the picking direction, generating an air current inside the yarn suction device in the drawing direction while the winding yarn guide is aligned with the yarn suction device disposed in front of the weft yarn measuring and storing device, and keeping a retaining pin from being advanced toward the drum. Thereafter the broken weft yarn on the drum is discharged by retracting the retaining pin.

1 Claim, 4 Drawing Sheets

METHOD OF DISCHARGING A WEFT YARN WOUND AROUND A DRUM

BACKGROUND OF THE INVENTION

1. Field of the Invention:

The present invention relates to a method of discharging a weft yarn on a drum of a drum type weft measuring and storing device.

2. Description of the Prior Art:

The Japanese Laid-Open Patent Publication Nos. 2-210043 and 3-180544 each discloses a method of discharging a yarn. That is, if a weft yarn is broken between a picking nozzle and a drum type weft yarn measuring and storing device, an air current is generated in a yarn guide for winding a yarn guided thereby a round a drum (referred to as a winding yarn guide hereinafter) in the picking direction after or when a retaining pin is retracted and the sucking operation of a suction pipe aligned with the winding yarn guide is started for delivering the yarn would around a drum to the suction pipe, so as to discharge the yarn out of the loom.

The prior art methods, however, cannot reliably deliver the weft yarn from the winding yarn guide to the yarn suction pipe, and have the following problems. That is, when the winding yarn guide jets air, the weft yarn which has been wound around a drum is unwound therefrom entailing a circular motion. As a result, the looped tip end of the unwound weft yarn not only revolves in accordance with the position of the drum from which it is unwound, but also vibrates as it is fanned by the air current, so that it is uncertain that the weft yarn reaches the suction pipe. Furthermore, when the winding yarn guide jets air, there is the possibility of unwinding of the wound yarn all at once, which prevents the weft yarn from reaching the yarn suction pipe.

SUMMARY OF THE INVENTION

Accordingly, it is an object of the present invention to solve the technical problems of the prior art methods set forth above and to perform the delivery of the weft yarn from the winding yarn guide to the yarn suction pipe and the succeeding discharge of the weft yarn with certainty.

When the weft yarn is broken between a fixed drum type weft yarn measuring and storing device and the picking nozzle, an air current is generated in the winding yarn guide in the picking direction while the winding yarn guide is put to be confronted aligned with a yarn sucking device positioned in front of the weft yarn measuring and storing device and a retaining pin is kept from being advanced toward the drum, so that the weft yarn is unwound a little from the drum by the air current; after the weft yarn is prevented by the retaining pin from being unwound therefrom, the weft yarn is drawn out only from a weft yarn package and a looped weft yarn formed between the winding yarn guide and the retaining pin is delivered to the yarn sucking device; thereafter the broken weft yarn on the drum is discharged by retracting the retaining pin.

Thus, since the looped weft yarn extending between the winding yarn guide and the retaining pin is kept on a plane, the tip end of the loop is delivered to the yarn sucking device without being rotated, and the looped weft yarn is delivered to the yarn sucking device without fail since the weft yarn wound around the drum is prevented from being accidentally unwound therefrom.

DESCRIPTION OF THE PREFERRED EMBODIMENT

Figure 1:
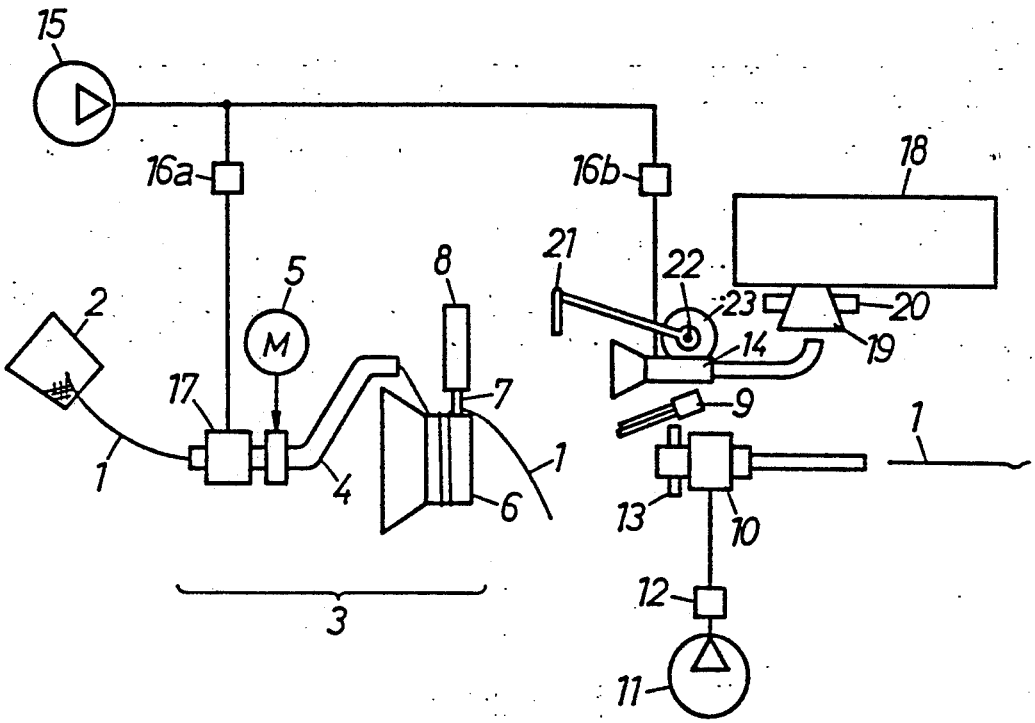
FIG. 1 is a plan view for explaining the state of the broken weft yarn between a weft yarn measuring and storing device and a picking nozzle.
Figure 2:
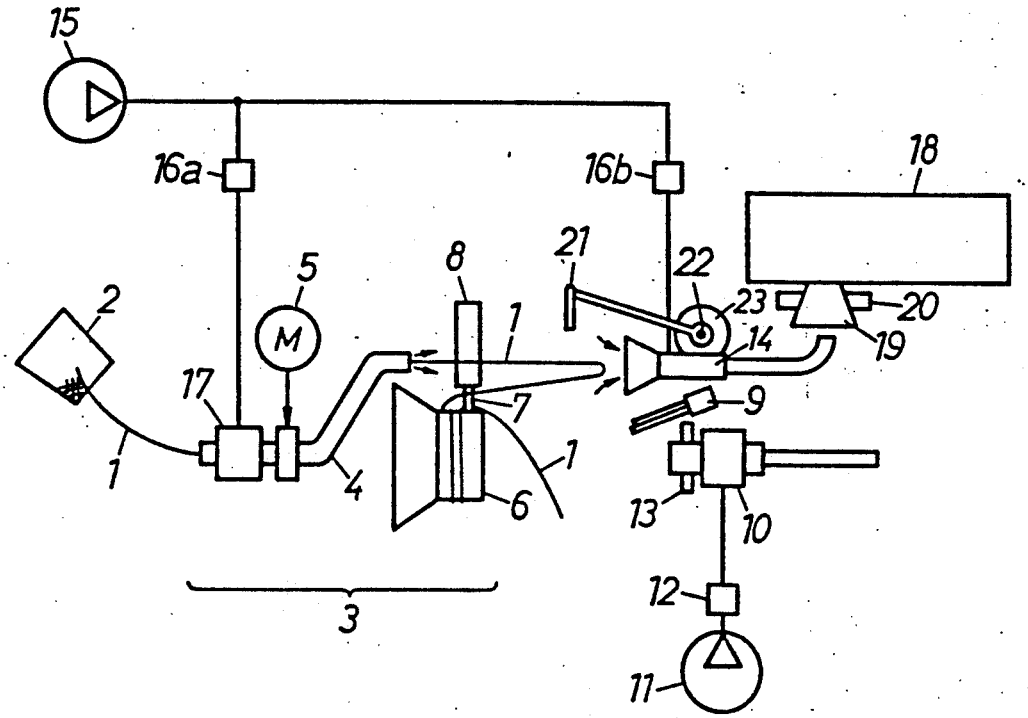
FIG. 2 is a view for explaining the process of delivery of the looped weft yarn from the winding weft yarn to a yarn sucking device.

FIGS. 1 to 4 show the operations of the main components of the device in performing the method of discharging a weft yarn wound around a drum according to the present invention. This embodiment assumes the employment of the device disclosed in U.S. Pat. No. 5,080,144.

A weft yarn 1 fed from a weft yarn package 2 is drawn into a winding yarn guide 4 in the fixed drum weft yarn measuring and storing device 3. The winding yarn guide 4 driven by a driving motor 5 measures the weft yarn 1 by winding the yarn around a fixed drum 6 at a given speed and storing the yarn thereon. A retaining pin 7 driven by an operating device 8 at the end of the picking cycle is advanced to the outer circumference of the drum 6 so as to complete the picking by retaining the weft yarn 1 unwound from the drum 6. The weft yarn 1 reaches the inside of a picking nozzle 10. When the operating device 8 retracts the retaining pin 7 during the picking cycle, the retaining pin 7 comes off the weft yarn 1 so that it is ready to be picked. At that time, a compressed fluid source 11 and a control valve 12 feed a picking fluid into the picking nozzle 10, which jets the picking fluid into a shed for picking the weft yarn 1.

When the weft yarn 1 is broken between the weft yarn measuring and storing device and the picking nozzle 10 during the picking operation as illustrated in FIG. 1, a yarn breakage sensor 13 detects the breakage of the weft yarn 1, for example, by detecting the absence of the weft yarn 1 on the inlet side of the picking nozzle 10. At that time, a loom control system, not shown, drives the operating device 8 upon reception of the yarn breakage signal from the yarn breakage sensor 13 to advance the retaining pin 7 to the outer circumference of the drum 6 for retaining the weft yarn 1 thereon and at the same time stops the loom instantly. Thereafter, the control system places the outlet of the winding yarn guide 4 in alignment with the inlet side of the yarn sucking device 14 by rotating the driving motor 5. The control of the rotating position of the winding yarn guide 4 can be carried out by providing a shaft encoder at a portion of the shaft of the winding yarn guide 4 or by regulating the amount of rotation (rotating angle) of the driving motor 5.

Then, a compressed air source 15 and control valves **16*a* and 16*b* generate an air current inside the winding yarn guide 4 in the picking direction and an air current inside the yarn sucking device 14 by supplying compressed air to a guide nozzle 17 fixed to the winding yarn guide 4** at the center of rotation thereof while keeping the retaining pin 7 from being. The weft yarn 1 is fed from the side of the weft yarn package 2 by the air current inside the winding yarn guide 4, and is discharged from the output portion of the winding yarn guide 4 in a loop shape and enters the yarn sucking device 14 led by the looped portion thereof and further reaches the inside of the sucking inlet 19 of a yarn disposing device 18. At that time, a yarn sensor 20 confirms the arrival of the weft yarn 1 by photoelectrically detecting the presence of the weft yarn 1 adjacent to the sucking inlet 19 of the yarn disposing device 18. After confirming the arrival of the weft yarn 1, the control valve 16*a* stops supplying compressed air to the guide nozzle 17.

As described above, since an air current is generated inside the winding yarn guide 4 in the picking direction while the retaining pin 7 is kept from being advanced to the outer circumferential surface of the drum 6 in the process of delivering the weft yarn 1 from the winding yarn guide 4 to the yarn sucking device 14, the weft yarn 1 is accurately delivered to the yarn sucking device 14. That is, since one of the end portions of the weft yarn 1 fed in a loop shape is linked to the outlet of the winding yarn guide 4 while the other end is retained by the retaining pin 7, the weft yarn 1 is stably positioned at the leading tip end portion thereof, and moreover since the weft yarn 1 wound around the drum 6 is retained by the retaining pin 7, the weft yarn 1 is prevented from being fed accidentally. It is preferable to set the rotational stopping position of the winding yarn guide 4 in the delivery process so as to be slightly downstream of the retaining pin 7 in the rotating direction of the winding yarn guide 4, because the weft yarn 1 fed in a loop shape is retained by the retaining pin 7 earlier under such a situation.

Figure 3:
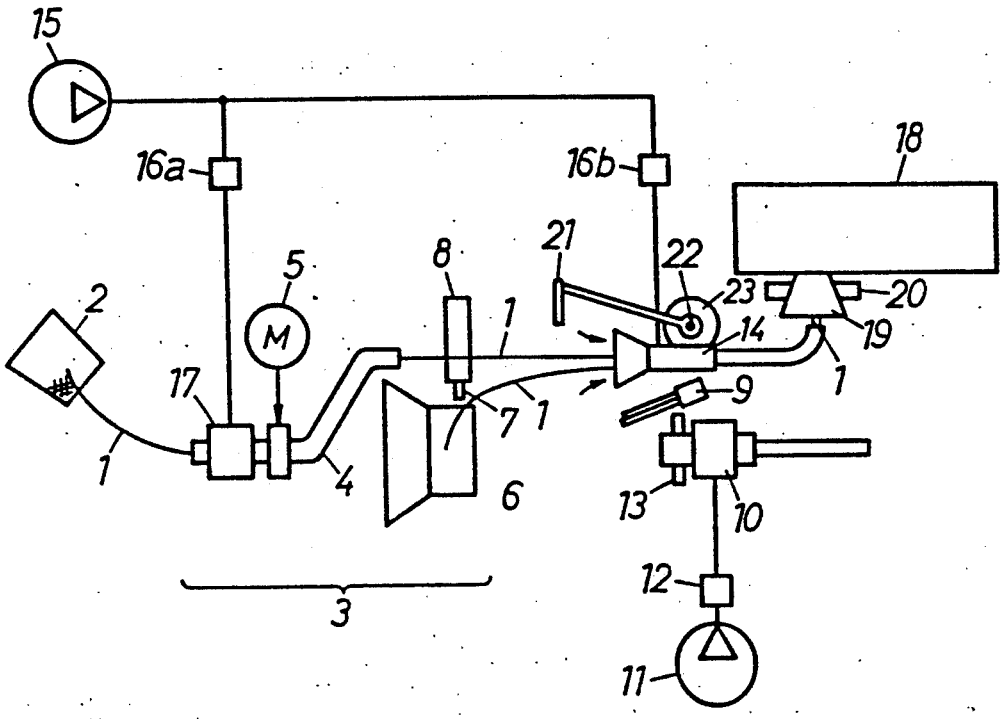
FIG. 3 is a view for explaining the process of discharging the weft yarn on the drum as it is unwound therefrom.

Thereafter, the operating device 8 retracts the retaining pin 7 and the yarn sucking device 14 sucks the weft yarn 1 which has been wound around the outer circumference of the drum 6 together with an air current and feeds the weft yarn 1 into the yarn disposing device 18 as illustrated in FIG. 3 and stops it sucking operation after a given time elapses has elapsed. As a result, the weft yarn 1 on the outer circumference of the drum 6 is removed therefrom and is fed into the yarn disposing device 18 by way of the yarn sucking device 14. At this state, the weft yarn 1 extending to the winding yarn guide 4 is linearly stretched between the outlet of the winding yarn guide 4 and the inlet side of the yarn sucking device 14.

Figure 4:
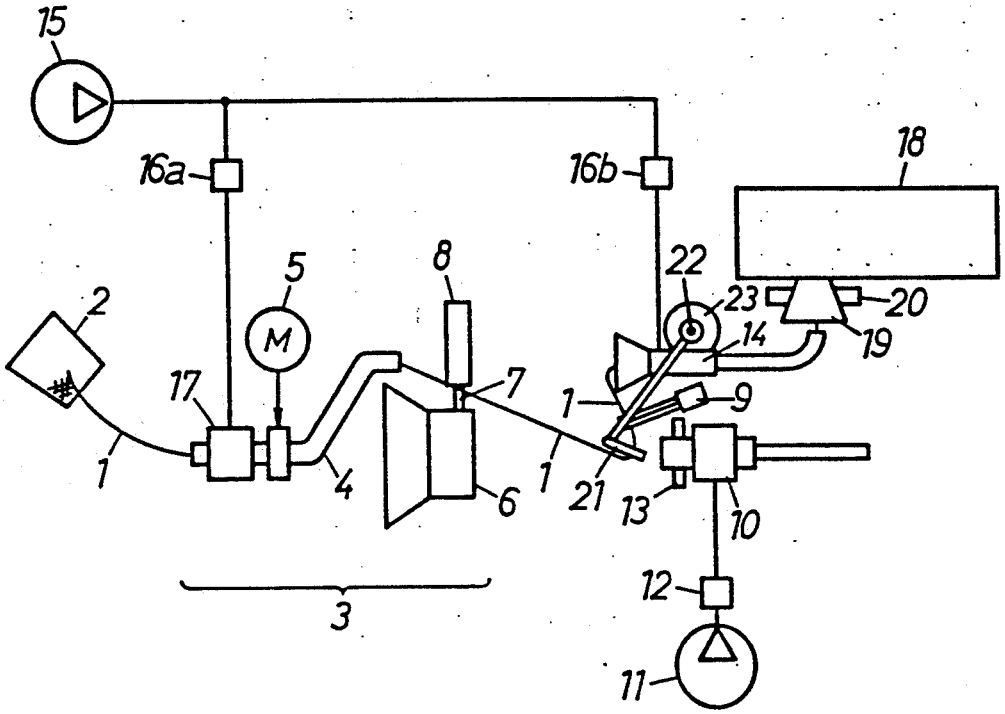
FIG. 4 is plan view for explaining the process of the delivery of the weft yarn between the winding yarn guide and the yarn sucking device to the picking nozzle by a yarn guide.

Then a rotary actuator 23 turns a furcate tipped yarn guide 21 by turning the shaft 22 thereof as illustrated in FIG. 4. During the turning, the yarn guide 21 slidably clamps the weft yarn 1 in its furcate portion, thereby displacing the weft yarn 1 toward the inlet side of the picking nozzle 10, when the picking nozzle 10 jets an air current and a cutter 9 cuts the weft yarn 1 between the inlet side of the picking nozzle 10 and the yarn sucking device 14. The weft yarn 1 guided by the yarn guide 21 enters the picking nozzle 10, which is threaded with the weft yarn 1. When the yarn breakage sensor 13 confirms the threaded state of the picking nozzle 10, the yarn guide 21 returns to its standby position. Hence the picking nozzle 10 is threaded with a new weft yarn 1.

Thereafter, the retaining pin 7 is advanced to the outer circumference of the drum 6 by the operating device 8 so as to be ready to retain the weft yarn on the drum. Then the driving motor 5 rotates the winding yarn guide 4 by a given amount of rotation so as to have the drum preliminarily wound with the weft yarn 1 by the necessary number of turns needed for the next picking. In this way, when the weft yarn 1 is broken, the broken weft yarn 1 is discharged from the outer circumference of the drum 6 and the succeeding weft yarn 1 is passed through the picking nozzle 10 and is preliminarily wound around the drum in the weft yarn measuring and storing device 3 so as to be ready for the next picking.

Although the yarn sucking device 14 is arranged off the axis of the drum 6 in the embodiment set forth above, it may be thereon as disclosed in the Japanese Laid-Open Patent Publication No. 3-180544, or it can be so constructed as to be displaced to a given position from a standby position. In any event, the inlet portion of the yarn sucking device 14 should be confronted in alignment with the outlet portion of the winding yarn guide 4 so as to be able to receive the weft yarn 1 by way of an air current.

Moreover, although the weft yarn is fed from the weft yarn package by the air current jetted from the winding yarn guide alone according to the above embodiment, a pair of feed rollers may be provided between the weft yarn package and the weft yarn measuring and storing device for feeding the weft yarn nipped as it rotates when the drawing resistance of the weft yarn is large.

Furthermore, the operation of the retaining pin is not limited to the above embodiment, but for example, the retaining pin may be advanced onto the surface of the drum after the weft yarn is fed as long as the looped tip and thereof does not reach the sucking device 14.

Since an air current is generated inside the winding yarn guide in the picking direction while the retaining pin is kept from being advanced to the outer circumference of the drum, the looped weft yarn formed between the retaining pin and the winding yarn guide extension is increased toward the inlet of the sucking device since it is fed only from the winding yarn guide. Accordingly, the tip end of the weft yarn in a loop shape is stably positioned, and moreover, since the weft yarn wound around the drum is prevented from being unwound accidentally, the weft yarn can be delivered to the yarn sucking device with certainty.

What is claimed is:

1. A method of discharging a weft yarn in a jet loom when said weft yarn is broken between a picking nozzle and a fixed drum type weft yarn measuring and storing device, comprising the steps of:

delivering a weft yarn in a looped shape with end portions and a leading tip end extending between a winding yarn guide and a drum in said weft yarn measuring and storing device to a yarn sucking device aligned with an outlet of said winding yarn guide by generating an air current in said winding yarn guide of said weft yarn measuring and storing device in a picking direction while keeping a retaining pin from being advanced to said drum in said weft yarn measuring and storing device, whereby one of the end portions of said weft yarn fed in a loop shape is linked to said outlet of said winding yarn guide while the other end is retained by said retaining pin, thereby stably positioning said weft yarn at the leading tip end portion thereof;

delivering said looped weft yarn to said yarn sucking device;

retracting said retaining pin from the surface of said drum after said sucking device receives said looped weft yarn; and drawing the delivered weft yarn so as to discharge the weft yarn on the drum.

* * * * *